United States Patent [19]

Halm

[11] 4,406,076

[45] Sep. 27, 1983

[54] CARD INDEX FOR FIXING TO A VERTICAL WALL OR FOR PLACING ON A BASE

[75] Inventor: Hans Halm, Herne, Switzerland

[73] Assignee: Confon AG, Switzerland

[21] Appl. No.: 233,408

[22] Filed: Feb. 11, 1981

[30] Foreign Application Priority Data

Jan. 23, 1981 [DE] Fed. Rep. of Germany ..... 3102158

[51] Int. Cl.[3] ..... B42F 17/00; B42F 13/00

[52] U.S. Cl. ..... 40/389; 40/532; 40/382; 209/610; 209/613

[58] Field of Search ..... 40/373, 374, 375, 380, 40/381, 382, 383, 384, 385, 532, 536, 389; 209/608, 610, 613

[56] References Cited

U.S. PATENT DOCUMENTS

| | | | |
|---|---|---|---|
| 3,167,371 | 1/1965 | Parcher et al. | 40/381 |
| 3,236,574 | 2/1966 | Woulbroun | 40/381 |
| 3,276,155 | 10/1966 | Conia | 40/375 |
| 3,423,862 | 1/1969 | Koller | 40/375 |
| 3,991,495 | 11/1976 | Wilson | 40/375 |
| 4,064,643 | 12/1977 | Greif | 40/383 |
| 4,100,060 | 7/1978 | Halm | 209/613 |
| 4,129,215 | 12/1978 | Halm | 40/389 |
| 4,187,631 | 12/1980 | Zandelin | 40/381 |

FOREIGN PATENT DOCUMENTS

| | | | |
|---|---|---|---|
| 2530106 | 1/1977 | Fed. Rep. of Germany | 40/383 |
| 2053095 | 2/1981 | United Kingdom . | |

*Primary Examiner*—Gene Mancene
*Assistant Examiner*—David Tarnoff
*Attorney, Agent, or Firm*—Beveridge, De Grandi & Kline

[57] ABSTRACT

The invention relates to a card index which can be fixed to a vertical wall or vertically mounted on a base, in which the index cards are held by means of clamping devices in a receiving compartment formed in covered manner in the upper part of the index casing and are individually released on operating a selection key and transferred into the lower area of the casing provided with a window-like opening for inspection, the cards being secured and locked in the clamping device, so that a reliable release of the selected cards is possible, including those cards made from a material with a smooth surface such as e.g. plastics foil and in which incorrect manipulations are not possible.

15 Claims, 18 Drawing Figures

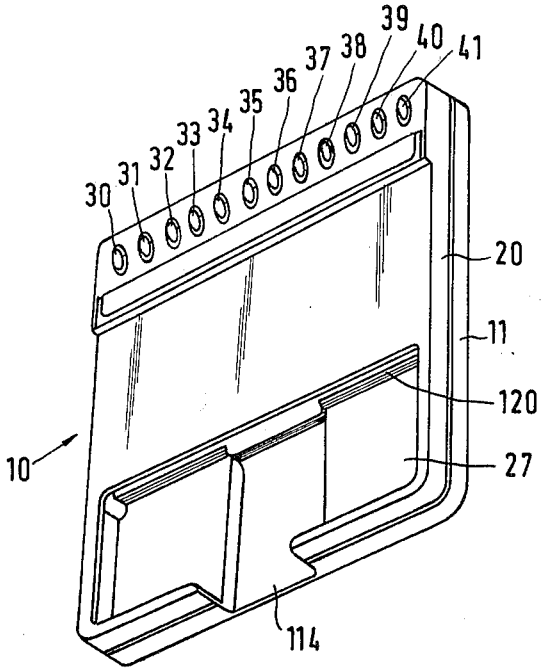
Fig.1
Fig.2
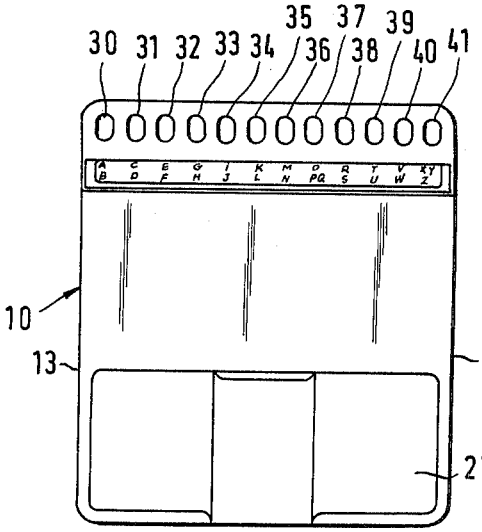
Fig.3
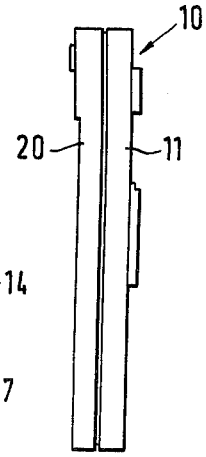

CARD INDEX FOR FIXING TO A VERTICAL WALL OR FOR PLACING ON A BASE

BACKGROUND OF THE INVENTION

The invention relates to a card index for fixing to a vertical wall or for placing on a base, comprising a basing for receiving index cards with selection tongues forming a staircase-like arrangement running from one side of the card to the other and carrying prefixes, letters, reference details, etc and means for holding and releasing the index cards selected by means of a set key.

Card indexes with selection devices are known in many different forms. They comprise a casing for receiving a stack of loose index cards and a keyboard with correspondingly marked keys, whose operation leads to the selection of the desired cards. The index cards can carry in alphabetical order random details or notes for subsequent reference. A known construction of a card index is relatively flat in the closed state and is opened by means of a plurality of keys operated manually in order to open the index at the desired point and to make the information on the cards freely visible. In addition, an index constructed in this way is provided with a closing key by means of which the cover covering the index cards can be brought into the closed position. Simultaneously with the closing of the cover, the raised cards are automatically returned to the initial position.

In addition, a card index is known comprising a casing with a drawer for receiving the index cards under the action of a thrust spring and closed by a bolt and with a device for unlocking the drawer and releasing the card selected by means of a set key by forcing out the unlocked drawer by means of the thrust spring.

These known card indexes are constructed in console form and are placed on a base support. The card index casing can also be provided with a base for supporting a telephone, if said casing is provided with a drawer moving the selected cards out of the casing.

In the case of these known card indexes, incorrect manipulations often occur, due to the high frictional forces down between the individual cards which particularly occur when the cards have been in use for a long time. Due to the said frictional forces, not only the selected card, but also further cards are often moved out together with the drawer, because the holding-back devices provided in the card index do not have an adequate locking and holding-back action for the index cards located above the selected card and which are not to be moved out with it.

BRIEF SUMMARY OF THE INVENTION

The problem of the invention is to provide a card index held on a wall in the vertical position or arranged vertically on a base, permitting a completely satisfactory release of the selected index cards and which also permits the use of cards made from a material with a smooth surface, such as e.g. a plastics foil and which also excludes incorrect manipulations.

According to the invention, this problem is solved by a card index of the aforementioned type in that the casing comprising a base and a cover is provided with a compartment for receiving the index cards formed in the upper casing portion, having tongue-like edge portions provided with openings in the vicinity of the steps and held in the vertical position in the compartment with the tongue-like edge portions by means of locking and holding devices connected to selection keys for releasing the individual index cards; the box-like base has a length corresponding approximately to double the height of the cards and carries elastic tongues adjacent to its upper edge facing the tongue-like edge portions of the cards and onto whose upper free ends are shaped the selection keys and which on the inside of the case carrying retaining cams which are perpendicular to the base plate plane having an approximately triangular shape with circular sliding and abuting surfaces made gradually steeper from the centre of the base to its two lateral longitudinal edges and which rise from the base plate into an upwardly tapering upper portion for receiving the openings on the tongue-like edge portions of the index cards and provided with a rear portion which is roughly perpendicular to the base plate; the cover covering the upper half of the base on the inside and facing the retaining cams of the base has a number of counter-holding members corresponding to the number of cams, whereof each counter-holding member has a hole or trough-like recess for receiving the tapering, upper end portion of each retaining cam and a height corresponding approximately to the distance from the cover plate to the end of the retaining cams, the height of the counter-holding members decreasing approximately from the centre member to the outer members as a function of the height of the cams in such a way that between the retaining cams and the counter-holding members on the inside of the cover, the tongue-like portions on the index cards are secured when the end portions of the retaining cams pass through their openings and are supported in the recesses of the counter-holding members; and that on depressing a selection key, the selected index card is released and transferred to the lower area of the casing for inspection.

Due to the fact that the tongue-shaped edge portions of the index cards are provided with openings through which can pass the upwardly tapering upper portions of the retaining cams and are supported in the recesses in the counter-holding members, a reliable locking and securing of the cards is ensured when the card indexes are in a vertical position. On operating a selection key, the retaining cam holding the selected index card is moved with its upwardly tapering upper portion out of the recess in the corresponding counter-holding member and out of the opening in the tongue-shaped edge portion of said selected card, so that the card is released and transferred into the lower area of the casing. Following inspection of the card, the latter is merely moved upwards until the retaining cam associated therewith passes with its upwardly tapering upper portion through the opening in the tongue-shaped edge portion of said card and engages in the recess of the counter-holding member. Thus, the index card is again locked in the receiving compartment of the card index. This specially shaped fastening and clamping device prevents incorrect manipulation in that the individual cards are so securely held in the compartment that on releasing a card, even if high frictional forces occur between the cards, only the selected card is released and no further card is also drawn out of the fastening. In addition, the specially constucted fastening and clamping device offers the possibility of using index cards made from plastics foils, which can be securely held in the receiving compartment despite their smooth surfaces.

Further advantageous developments of the invention can be gathered from the subclaims.

BRIEF DESCRIPTION OF THE DRAWINGS

The invention is described in greater detail hereinafter relative to non-limitative embodiments and the attached drawings, wherein show:

FIG. 1 is a plan view of a card index comprising a base and a cover.

FIG. 2 a front view of the card index with inserted index cards.

FIG. 3 a side view of the card index.

DETAILED DESCRIPTION OF THE PREFERRED EMBODIMENTS

Figure 11:
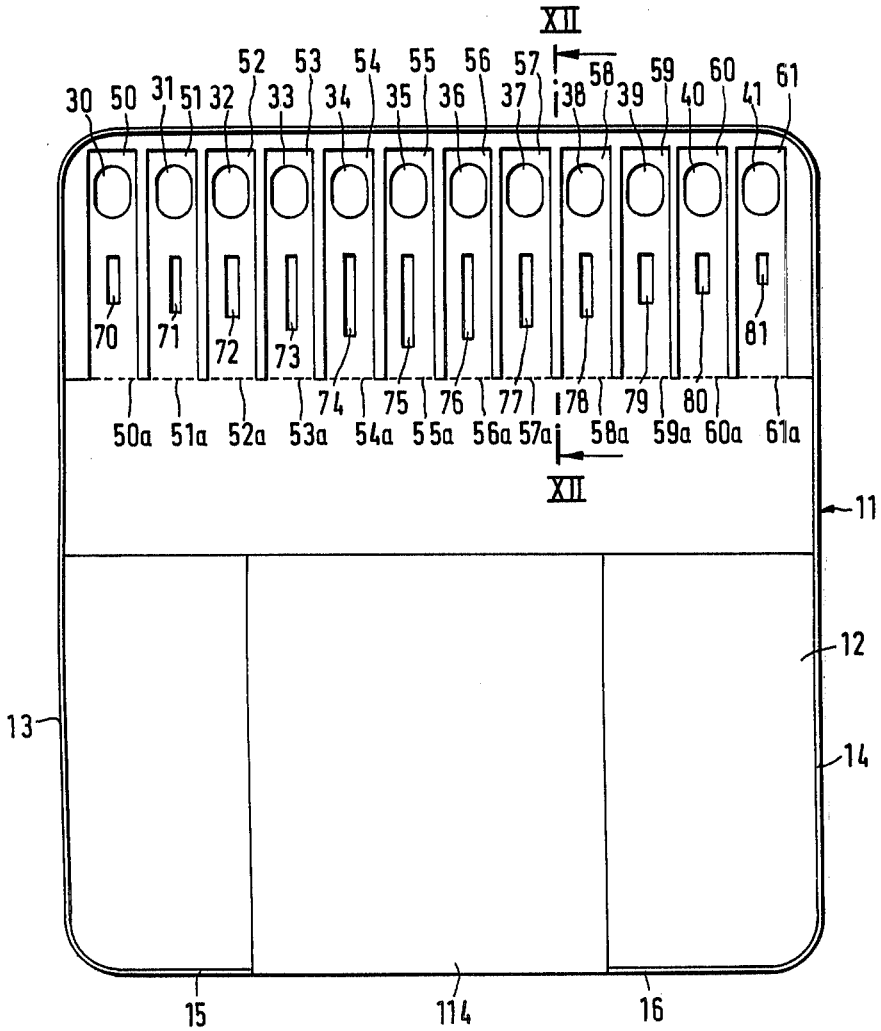
FIG. 11 the base with selection keys shaped on resilient tongues in a plan view.
Figure 12:
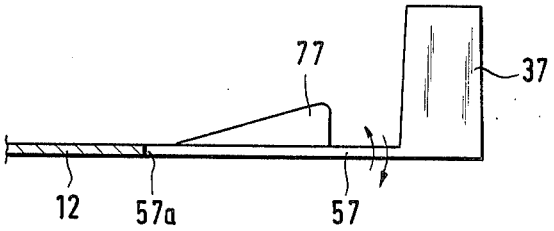
FIG. 12 a vertical section along the line XII—XII of FIG. 11.

Therefore, according to the preferred embodiment of FIGS. 1 to 7, the card index comprises a casing 10 with a box-like base 11, whose base plate is 12. Onto the longitudinal edges thereof are shaped sidewalls 13, 14 and on the base side stop edges 15, 16 connected to sidewalls 13, 14 (FIG. 11). Base 11, whose length is approximately double the height of the cards used, is covered by means of an also box-shaped cover 20, which only covers the upper half of base 11, whilst forming a receiving compartment for the cards. The height of cover 20 approximately corresponds to half the length of base 11.

Figure 8:
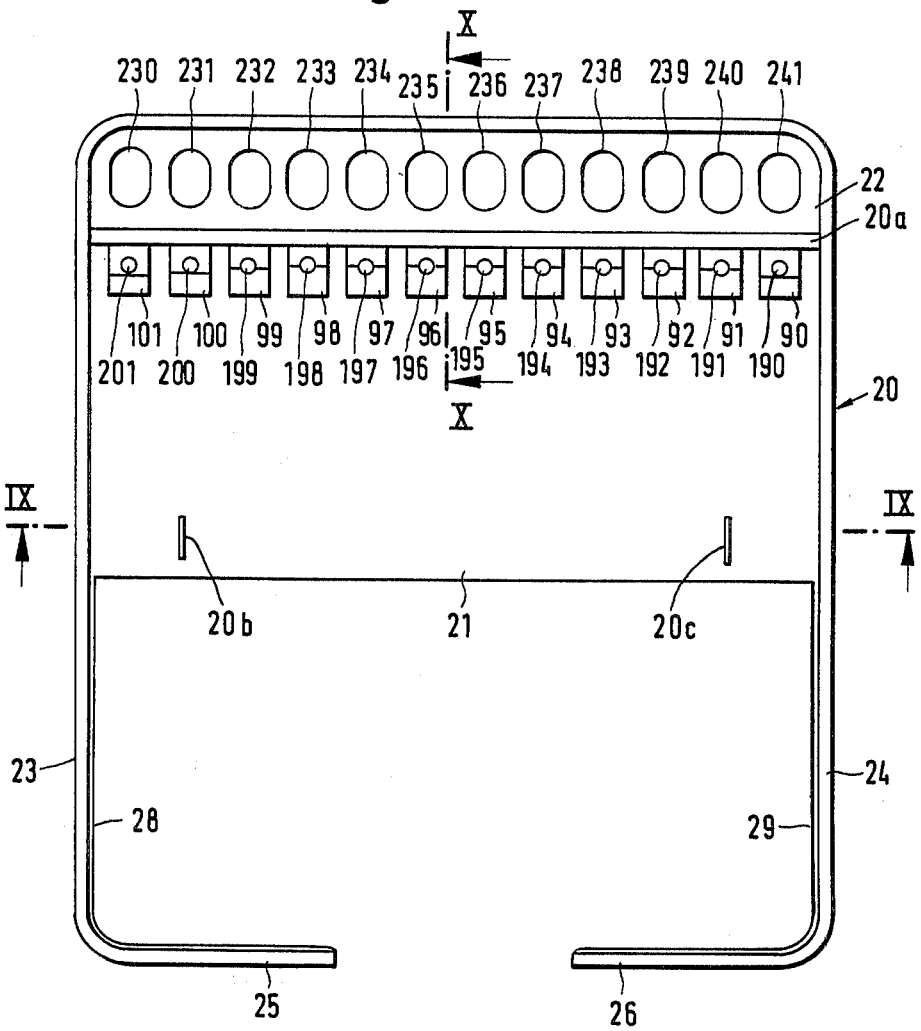
FIG. 8 the card index cover with shaped-on counter-holding members in a view from the bottom.
Figure 9:
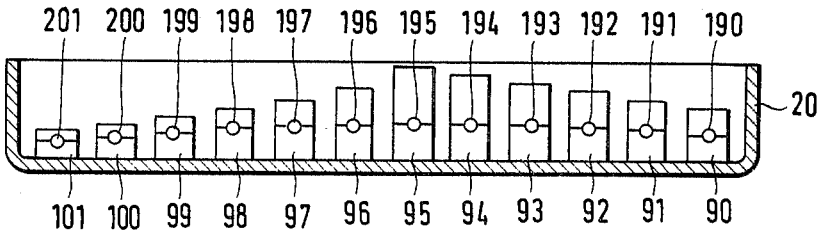
FIG. 9 a vertical section along line IX—IX of FIG. 8.

Cover 20 comprises the cover plate 21 onto whose longitudinal edges are shaped sidewalls 23, 24 passing into lower bent stop edges 25, 26 with the formation of lateral legs 28, 29 (FIG. 8). With cover 20 placed on base 11, the stop edges 25, 26 face the stop edges 15, 16 of base 11. The upper edges of sidewalls 13, 14 and the top edges 15, 16 of base 11, as well as the upper edges of sidewalls 23, 24 and the stop edges 25, 26 of cover 20 are provided with shaped sections in order to ensure a flush transition of the sidewalls from the base to the cover, when cover 20 is placed on base 11. The two lateral legs 28, 29 of cover 20 define a window-shaped opening 27, in whose vicinity are placed the cards following the operation of the selection device. Adjacent to the upper edge, cover 20 has a portion 22 serving to receive the keys of the selection device. This portion 22 is separated on the inside of the cover plate from the remainder of cover 20 by means of a separating web 20*a* (FIG. 8). In the vicinity of portion 22, reference numbers, letters, etc for defining the individual selection keys are placed on the outside of the cover, for the case where the keys are not provided with corresponding symbols referring to the appropriate cards (FIG. 2).

Base 11 and cover 20 are made from plastics materials, but other materials can also be used. In the vicinity of its window-like opening 27, cover 20 has circular guide cams 20*b*, 20*c* running in the longitudinal direction of the cover for the purpose of facilitating the insertion of the cards into the receiving compartment.

Figure 16:
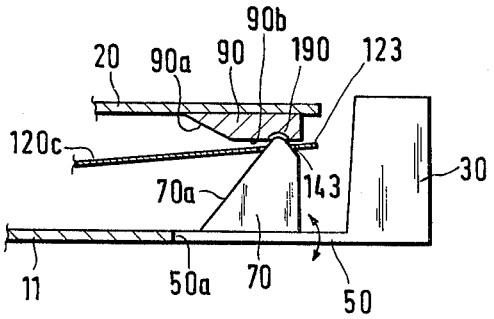
FIG. 16 the securing of an index card between a retaining cam and a counter-holding member, partly in elevation and partly in vertical section.

The selection device for the individual index cards comprises a series of juxtaposed keys 30,31,32,33,34,35,36,37,38,39,40,41 (FIGS. 1, 2 and 11), fixed to the free ends of elastic tongues 50, 51, 52,53,54,55 56,57,58,59,60,61. These elastic tongue-like portions 50 to 61 are fixed to base plate 12 of base 11 at 50*a*,51*a*,52*a*,53*a*,54*a*,55*a*,56*a*,57*a*,58*a*,59*a*,60*a*,61*a* in such a way that when pressure is exerted on selection keys 30 to 41, the tongue-shaped portions 50 to 61 are bent rearwards, whilst springing back into their initial position when the pressure is removed (FIGS. 11 and 16). The tongue-shaped portions 50 to 61 can be made from corresponding, suitable, elastic plastics material or spring steel. They can be fixed to base plate 12 of base 11 or can be shaped onto base plate 12, i.e. can be connected in one piece with said base plate. In the vicinity of selection keys 30 to 41, portion 22 of cover 20 has openings 230,231,232,233,234,235,236,237,238,239,240,241 for the selection keys. When cover 20 is placed on base 11, selection keys 30 to 41 come to rest in openings 230 to 241 and a portion projects through said openings (FIG. 1).

Figure 13:
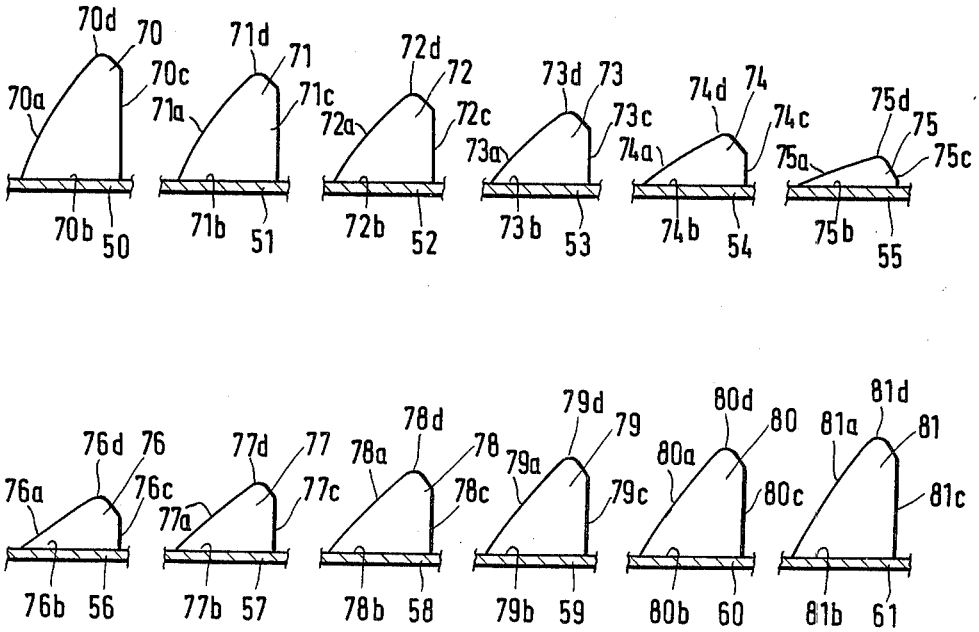
FIG. 13 the retaining cams shaped onto the resilient tongues of the selection keys, partly in elevation and partly in vertical section.

In order to be able to hold the index cards in the casing, each tongue-shaped portion 50 to 61 has retaining cams 70, 71, 72,73,74,75,76,77,78,79,80,81 having an approximately triangular shape with a circular abuting and sliding surface 70*a*,71*a*,72*a*,73*a*,74*a*,75*a*,76*a*,77*a*,78*a*,79*a*,80*a*,81a. The circular abuting and sliding surfaces 70*a* to 81*a* rise from base plate 12 and in each case pass into a portion 70*b*,71*b*,72,73*b*,74*b*,75*b*,76*b*,77*b*,78*b*,79*b*,80*b*,81*b* running horizontally with respect to base plate 12. Retaining cams 70 to 81 are positioned vertically on the surface of base plate 12 of base 11. The rear portions 70*c*,71*c*,72*c*,73*c*,74*c*,75*c*,76*c*,77*c*,78*c*,79*c*,80*c*,81*c* of retaining cams 70 to 81 facing the selection keys 30 to 41 are constructed so as to be vertically directed (FIG. 13). The circular abuting and sliding surfaces 70*a* to 81*a* and the rear perpendicular portions 70*c* to 81*c* of retaining cams 70 to 81 pass into upwardly tapering portions 70*d*,71*d*,72*d*,73*d*,74*d*,75*d*,76*d*,77*d*,78*d*,79*d*,80*d*,81*d*.

The abuting and sliding surfaces 70*a* to 81*a* of retaining cams 70 to 81 are made increasingly steeper approximately from the centre of base plate 12 to its two lateral longitudinal edges 13, 14, the height of the individual cams 70 to 81 being such that cam 75 is smaller than cam 76, the latter is smaller than cam 77, the latter is smaller than cam 78, the latter is smaller than cam 79, the latter is smaller than cam 80 and the latter is smaller then cam 81, whilst the cam 74 is larger than cam 75 but smaller than cam 76, cam 73 is larger than cam 74 but smaller than cam 77, cam 72 is larger than cam 73 but smaller than cam 78, cam 71 is larger than cam 72 but smaller than cam 79 and cam 78 is larger than cam 71 but smaller than cam 80 (FIG. 13).

Figure 10:
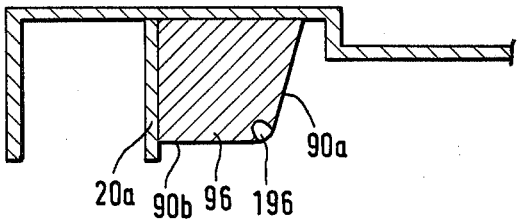
FIG. 10 a vertical section along line X—X of FIG. 8.

Whilst selection keys 30 to 41 on the tongue-shaped portions 50 to 61 form one part of the clamping device for the individual index cards with retaining cams 70 to 81, the second part of the clamping device is fixed to the inside of cover 20. This part of the clamping device comprises counter-holding members 90,91,92,93,94,95,96,97,98,99,100,101 internally facing cover plate 21 and retaining cam 70 to 81 of base 11. The number of counter-holding members 90 to 101 corresponds to the number of retaining cams 70 to 81. The association of the retaining cams 70 to 81 and counter-holding members 90 to 101 takes place in such a way that retaining cam 70 faces counter-holding member 90, cam 71 member 91, cam 72 member 92, cam 73 member 93, cam 74 member 94, cam 75 member 95, cam 76 member 96, cam 77 member 97, cam 78 member 98, cam 79 member 99, cam 80 member 100 and cam 81 member 101. At the front, the counter-holding members 90 to 101 are chamfered and with said portions also form sliding and abuting surfaces indicated at 90*a* in FIGS. 10 and 16. These sloping portions 90*a* pass into a horizontal portion 90*b*, which is approximately parallel to cover plate 21. In the transition area between the sloping portion 90*a* and the horizontal portion 90*b*, the counter-holding members 90 to 101 are provided with hole or trough-shaped recesses 190,191,192,193,194,195,196,197,198,199,200,201. The arrangement of the recesses 190 to 201 in counter-holding members 90 to 101 is such that said recesses 190 to 201 face the upwardly tapering end portions 70*d* to 81*d* of cams 70 to 81 (FIGS. 8 and 16).

The height of each counter-holding member 90 to 101 approximately corresponds to the distance from cover plate 21 to the end of retaining cams 70 to 81. The height of the counter-holding members 90 to 101 decreases approximately from the central member 95 to the outermost members 90, 101, as a function of the height of retaining cams 70 to 81, namely in such a way that the remaining space between the upper end portions 70*d* to 81*d* of cams 70 to 81 and the inside of cover plate 21 is so bridged that if cover 20 is placed on base 11, cams 70 to 81 with their upwardly tapering portions 70*d* to 81*d* engage in the recesses 190 to 201 of counter-holding members 90 to 101. The arrangement and association of retaining cams 70 to 81 and counter-holding members 90 to 101 is such that the index cards are held in position between cams 70 to 81 and members 90 to 101 on the inside of cover 20 by means of tongue-shaped portions and detailed reference will be made thereto hereinafter (FIGS. 15, 15*a* and 16).

Figure 4:
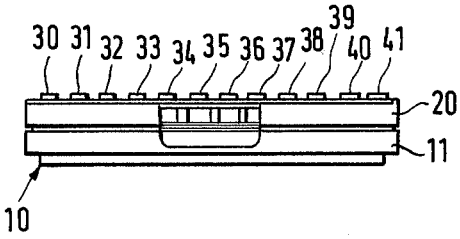
FIG. 4 a side view from the front of the card index.
Figure 5:
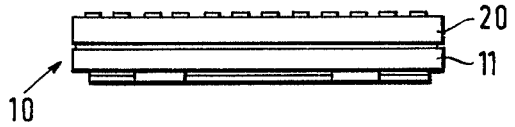
FIG. 5 a rear side view of the card index.
Figure 6:
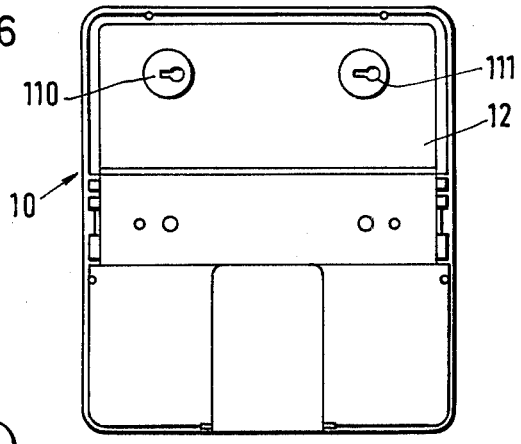
FIG. 6 a view of the base of the card index.
Figure 7:
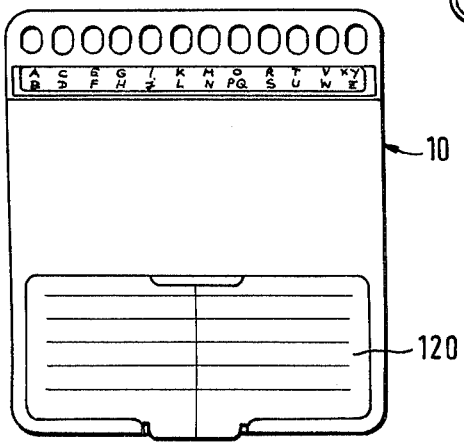
FIG. 7 a front view of the card index with a selected index card.

In order to be able to fix the card index to a wall or the like, base plate 12 of base 11 carries correspondingly shaped connecting means, such as e.g. openings 110, 111 in which can engage hooks fixed to the wall (FIG. 6). If the card index is fixed to a metal plate or the like, the connecting means can also be constructed as a magnet. In addition, the lower portion of base 11 has a gripping recess 114 in order to be able to manually return selected cards to the upper starting position, i.e. in the receiving compartment of casing 10 (FIG. 11).

Figure 14:
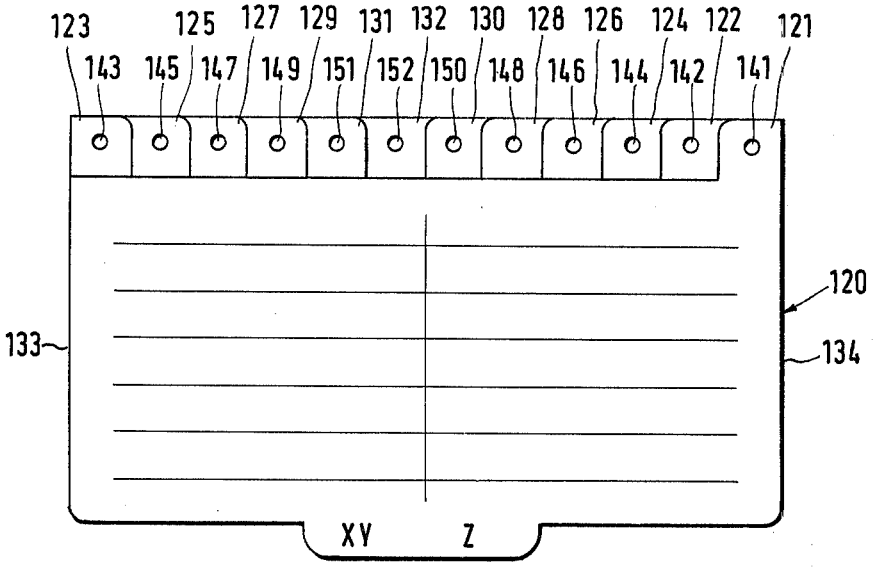
FIG. 14 a plan view of a plurality of superimposed index cards formed into a stack.
Figure 17:
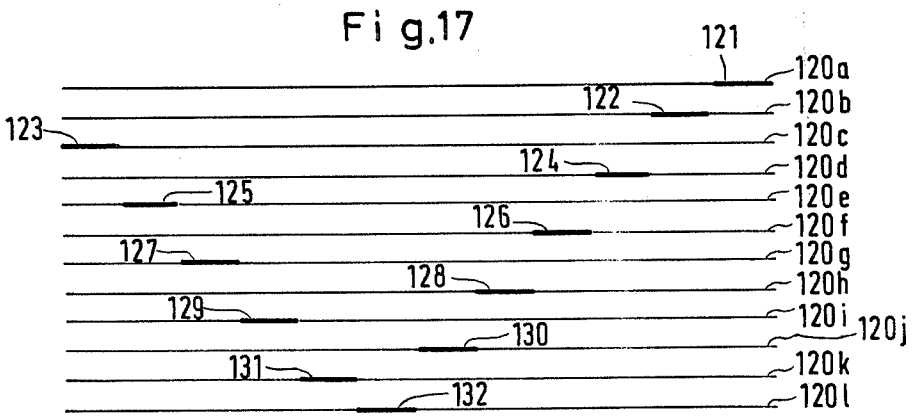
FIG. 17 a plan view of the index card stack with spread-apart index cards.

Casing 10 contains a stack 120 of index cards made from cardboard, pasteboard, etc. These index cards 120*a*, 120*b*, 120*c*, 120*d*, 120*e*, 120*f*, 120*g*, 120*h*, 120*i*, 120*j*, 120*k*, 120*l* are provided on their front ends with tongue-shaped portions 121,122,123,124,125,126,127,128,129,130,131,132, the latter being arranged in the manner of a stairway running from one narrow side 133 to the other narrow side 134 of the index card (FIGS. 14 and 17).

Figure 15:
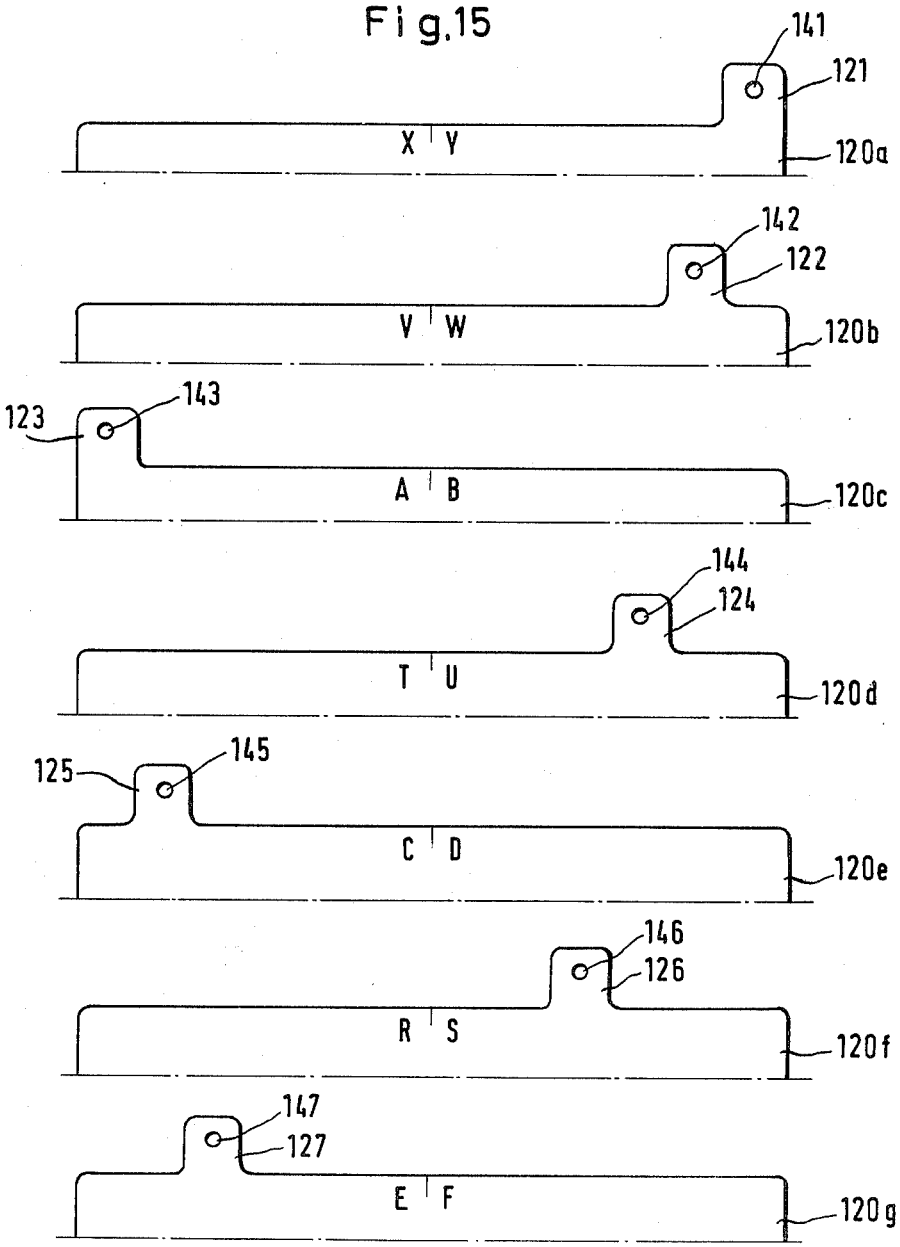
FIGS. 15, 15*a* the front portions of sequentially arranged index cards with selection tongues formed on their front edges in plan view.
Figure 15A:
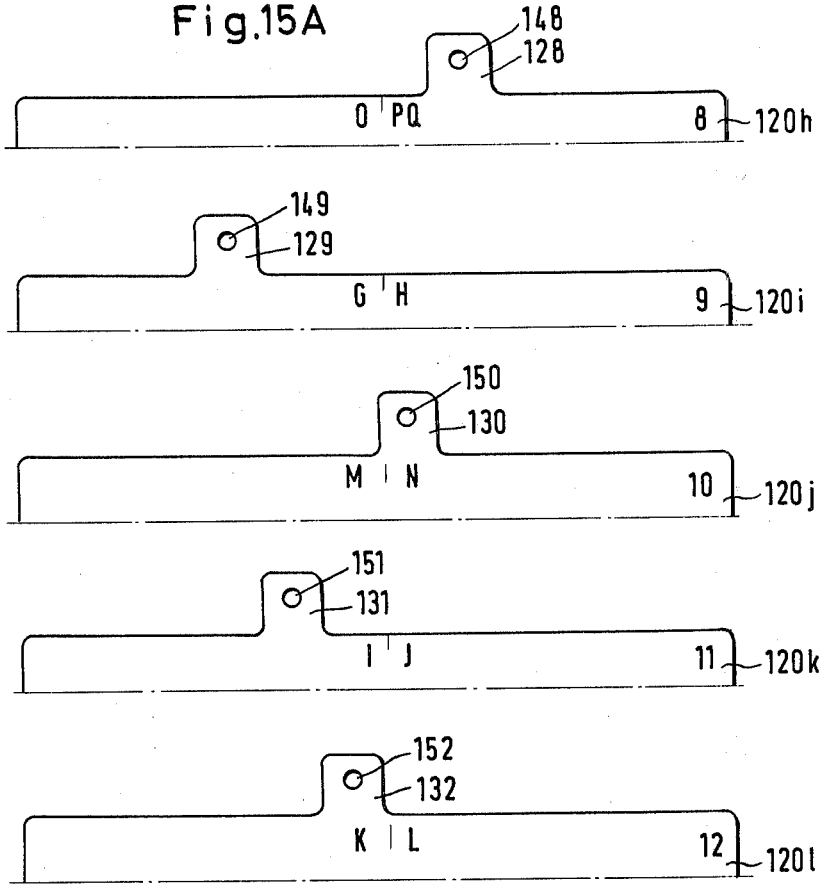

Each tongue-shaped portion 121 to 132 of index cards 120*a* to 120*l* is provided with an opening 141,142,143,144,145,146,147,148,149,150,151,152, the sides of said openings 141 to 152 corresponding to the upwardly tapering end portions 70*d* to 81*d* of retaining cams 70 to 81, so that each portion 70*d* to 81*d* passes through the associated opening 141 to 152 (FIGS. 15 and 15*a*).

Index cards 120*a* to 120*l* are held by their tongue-shaped portions 121 to 132 between retaining cams 70 to 81 and counter-holding members 90 to 101 in such a way that the openings 141 to 152 in portions 121 to 132 of cards 120*a* to 120*l* coincide with the recesses 190 to 201 of members 90 to 101 in such a way that the tongue-shaped portion 121 of card 120*a* is positioned between retaining cam 81 and counter-holding member 101 and opening 141 on recess 201, tongue-shaped portion 122 of card 120*b* between cam 80 and member 100 and opening 142 on recess 200, tongue-shaped portion 123 of card 123 between cam 80 and member 90 and opening 143 on recess 190, tongue-shaped portion 124 of card 120*d* between cam 79 and member 99 and opening 144 on recess 199, tongue-shaped portion 125 of card 120*e* between cam 71 and member 91 and opening 145 on recess 191, tongue-shaped portion 126 of card 120*f* between cam 78 and member 98 and opening 146 on recess 198, tongue-shaped portion 127 of card 120*g* between cam 72 and member 92 and opening 147 on recess 192, tongue-shaped portion 128 of card 120*h* between cam 77 and member 97 and opening 148 on recess 197, tongue-shaped portion 129 of card 120*i* between cam 73 and member 93 and opening 149 on recess 193, tongue-shaped portion 130 of card 120*j* between cam 76 and member 96 and opening 150 on recess 196, tongue-shaped portion 131 of card 120*k* between cam 74 and member 94 and opening 151 on recess 194 and tongue-shaped portion 132 of card 120*l* between cam 75 and member 95 and opening 152 on recess 195, the tongue-shaped portion 132 of index card 120*l* being arranged between the highest counter-holding member 125 and the lowest retaining cam 75 (FIGS. 8, 11 and 16).

In order to ensure a completely satisfactory operation of the card index, it is advantageous if the index cards 120*a* to 120*l* are made from an elastic material. It is possible to use plastics foils for producing the index cards, in addition to cardboard, pasteboard, etc. The counter-holding members 90 to 101 can be shaped onto the inside of cover plate 21. However, it is also possible to construct the counter-holding members 90 to 101 in the form of a continuous ledge or strip, but it must then have on the side facing the retaining cams 70 to 81 a number of portions of different heights corresponding to the number of cams 70 to 81. As a result, the upwardly tapering end portions 70*d* to 81*d* of cams 70 to 81 are so supported on the members 90 to 101 that portions 70*d* to 81*d* engage in the recesses 190 to 201 of members 90 to 101.

The card index can be used in the following way. When the card index fixed to a vertical wall is not in use, the index cards 120*a* to 120*l* are located in the upper receiving compartment, which is frontally bounded by cover plate 21 of cover 20, being specifically positioned in the individual clamping devices comprising retaining cams 70 to 81 and counter-holding members 90 to 101 on the tongue-shaped, elastic portions 50 to 61 with selection keys 30 to 41 in such a way that tongue-shaped portions 121 to 132 are secured between cams 70 to 81 and members 90 to 101. This securing action is also aided by the fact that the upwardly tapering end portion 70*d* to 81*d* of cams 70 to 81 pass through the openings 141 to 152 in the tongue-shaped portions 121 to 132 of index cards 120*a* to 120*l* and engage in recesses 190 to 201 of counter-holding members 90 to 101. This securing effect is illustrated in FIG. 16 relative to index card 120*c*. The end portion of retaining cam 70 engages through the opening 143 in the tongue-shaped portion 123 of said card, entering the recess 190 of counter-holding member 90 fixed to the inside of cover 20 (FIG. 16).

If one of the selection keys 30 to 41 is pressed rearwards by means of fingers, the corresponding tongue-shaped portion with the corresponding retaining cam is also moved rearwards, so that the clamping action between the relevant retaining cam and the counter-holding member associated therewith is eliminated on the inside of cover 20 and due to its specific gravity, the particular card drops into the lower part of casing 10 and comes to rest in the vicinity of the window-like opening 27 of cover 20. Thus, the complete size of the selected index card is available for inspection or for writing on.

The selected index card is returned to the initial position by moving said card manually into the receiving compartment of the card index until the particular tongue-shaped portion of the raised card is engaged by the clamping device and the upwardly tapering end portion of the corresponding retaining cam passes through the opening in the tongue-shaped portion of said card and engages in the recess of the corresponding counter-holding member. Due to the elastic construction of the tongue-shaped portions 50 to 61 of selection keys 30 to 41 it is possible to springing back of the selection keys and therefore also retaining cams 70 to 81 in the vicinity of the counter-holding members 90 to 101 on the inside of cover 20 on removing the pressure exerted on the selection keys.

This card index can be manufactured with minimum constructional and manufacturing expenditure and is particularly reliable. Incorrect selection is also excluded if the index cards acquire a rough surface due to repeated use so that, due to the high frictional forces further cards would be displaced with the selected card. The use of index cards made from plastics foils also ensures completely satisfactory operation, because in the inserted position the cards are not only held in the clamping devices by the clamping action thereof, but also an anchoring effect is obtained in that the upwardly tapering end portions 70*d* to 81*d* of retaining cams 70 to 81 pass through the openings 141 to 152 in the tongue-shaped portions 121 to 132 of index cards 120*a* to 120*l* and engage in recesses 190 to 201 of counter-holding members 90 to 101. On wishing to write on the index cards, each card can be effortlessly removed from the casing, because the selected cards are laterally held in the vicinity of the window-shaped opening 27 of card 20. The index cards moved out are always in the correct viewing position. The card index is not only usable as a telephone index, but can be used wherever it is desired to catalogue goods, articles, meals, etc.

I claim:

1. A card index for index cards which have a predetermined height with tongue-shaped edge members extending from the top edge thereof to form a step-like graduation running along the top edge when the index cards are positioned within said card index, each edge member having a hole therethrough, said card index adapted to be attached to a vertical wall, said card index comprising:

(a) a casing member with a base part and a cover part adapted to fit together to form a receptacle of a height substantially twice the height of the index cards, said base part having a planar base portion, said cover extending over the upper one-half of said casing member to define an opening;

(b) a plurality of elastic tongues extending from said base part and within said receptacle;

(c) a plurality of selection keys extending from said elastic tongues and through openings in said cover part;

(d) a plurality of substantially triangular holding cams extending from said elastic tongues and substantially perpendicularly to the plane of said planar base portion and within said receptacle, each of said holding cams having an edge substantially perpendicular the plane of said planar base portion, an inclined arcuate stopping and gliding surface, the inclined edge of adjacent ones of said holding cams being more and more steeply inclined from that holding cam positioned at about the middle of the base part to those holding cams positioned at both side edges of the base part, said holding cams rising from the base plate to a distal end;

(e) a plurality of counter holders extending from said cover part and within said receptacle and positioned opposite said holding cams, each counter holder having an indentation to receive the top distal end of the opposite holding cam and having a height that corresponds to the distance between the cover plate and the distal end of the opposite holding cam, whereby the height of the counter holders depends on the height of the holding cams such that from about the middle counter holder to the outside counter holders the height thereof diminishes, each opposite holding cam and counter holder adapted to clamp the tongue-shaped edge member of an index card, with said distal ends of said holding cams extending through the holes in the tongue-shaped edge parts and into the indentations of said counter holders, depression of one of said selective keys causing the associated index card to be released and to move to the lower area of the casing for inspection through said opening.

2. A card index as claimed in claim 1 wherein said base part includes a stop edge for stopping movement of the selected index cards at the lower edge thereof.

3. A card index as claimed in claim 2 wherein said cover has lateral guides for the selected index cards, said guides bounding said opening.

4. A card index as claimed in claim 1 wherein the elastic tongues are made from spring steel.

5. A card index as claimed in claim 1 wherein the elastic tongues are made from elastic plastic material.

6. A card index as claimed in claim 1 wherein the elastic tongues are formed in one piece with said base part.

7. A card index as claimed in claim 1 wherein said holding cams extend from said elastic tongues in a first staircase arrangement to right of the center of said card index and in a second staircase arrangement to the left of the center thereof, with the heights of the cams to the right and left of the center being unequal to each other.

8. A card index for mounting on a vertical surface comprising:

a box-like base having a base plate adapted to be mounted on a vertical surface, said base having upper and lower portions, said upper portion of said base provided with a plurality of elastic tongues, each said elastic tongue having an upper free end with a selection key mounted thereon and having a retaining cam, each of said retaining cams having a tapered distal portion;

a cover adapted to overlie said upper portion of said base to define a receptacle and having a plurality of counter holding members within said receptacle with each counter holding member opposed to one of said retaining cams, said counter holding members having recesses to receive said distal portions of said cams, said cover having openings therethrough with said selection keys protruding through said openings for operation thereof, and a plurality of index cards between said base and said cover, each said card having an upwardly extending tab aligned with one of said cams, no two tabs being aligned with the same cam, each said tab having a hole for receiving the tapered distal portion of the cam aligned therewith, whereby with said card index mounted on a vertical surface each index card is retained in the upper portion of said base by the clamping of its tab between its aligned cam and a counter holding member on said cover and may be released by the depression of the selection key on the elastic tongue common to its cam to unclamp the tab and allow the card to fall by gravity to said lower portion of said base.

9. A card index as claimed in claim 8 wherein each of the cards is the same height and said base is approximately twice the height of the cards.

10. A card index as claimed in claim 8 wherein each cam has a sloping lower surface so that lowered cards can be easily raised for re-clamping.

11. A card index as claimed in claim 8 wherein each cam extends a distance away from said base plate corresponding to the distance from the base plate to the tab aligned therewith, and the counter holding member aligned therewith extends a complementary distance towards said cam.

12. A card index as claimed in claim 11 wherein said cams are arranged in a staircase-like array.

13. A card index as claimed in claim 11 wherein said cams are arranged in two staircase-like arrays extending to either side of the middle of the base.

14. A card index as claimed in claim 8 wherein said base has a stop edge for the selected index cards at its lower edge, and said cover has a lower area with a window-shaped opening of approximately the same size as the cards over said lower portion of said base.

15. A card index as claimed in claim 14 wherein said cover has lateral guides for the selected cards bounding said window-shaped opening.

* * * * *